US005509102A

United States Patent [19]

Sasaki

[11] Patent Number: 5,509,102

[45] Date of Patent: Apr. 16, 1996

[54] VOICE ENCODER USING A VOICE ACTIVITY DETECTOR

[75] Inventor: Seishi Sasaki, Sendai, Japan

[73] Assignee: Kokusai Electric Co., Ltd., Tokyo, Japan

[21] Appl. No.: 171,198

[22] Filed: Dec. 21, 1993

Related U.S. Application Data

[63] Continuation of Ser. No. 907,221, Jul. 1, 1992, abandoned.

[51] Int. Cl.[6] ..... G10L 9/00

[52] U.S. Cl. ..... 395/2.28; 395/2.21; 395/2.39

[58] Field of Search ..... 395/2.1–2.39; 381/29–40; 370/60; 375/27

[56] References Cited

U.S. PATENT DOCUMENTS

| | | | |
|---|---|---|---|
| 4,831,636 | 5/1989 | Taniguchi et al. | 375/27 |
| 4,860,313 | 8/1989 | Shpiro | 375/27 |
| 4,882,758 | 11/1989 | Uekawa et al. | 381/50 |
| 4,956,865 | 9/1990 | Lennig et al. | 381/50 |
| 5,058,168 | 10/1991 | Koyama | 381/46 |
| 5,130,985 | 7/1992 | Kondo et al. | 370/60 |

*Primary Examiner*—Allen R. MacDonald
*Assistant Examiner*—Michelle Doerrler
*Attorney, Agent, or Firm*—Emmanuel J. Lobato

[57] ABSTRACT

A voice encoder using a voice activity detector in which two predictive coefficients available from an adaptive predictor in the voice encoder are received for each sample of a input voice signal of the voice encoder. Average values of the predictive coefficients are calculated for each fixed period to decide whether the period is a voice active period or a voice non-active period as a result of comparing the average values with respective ranges of predictive coefficient threshold values predetermined from respective distributions of the two predictive coefficients. Voice active/non-active flags indicative of the voice active period and the voice non-active period are obtained for voice operate switch exchange of encoded of the voice encoder.

2 Claims, 7 Drawing Sheets

Fig. 4A
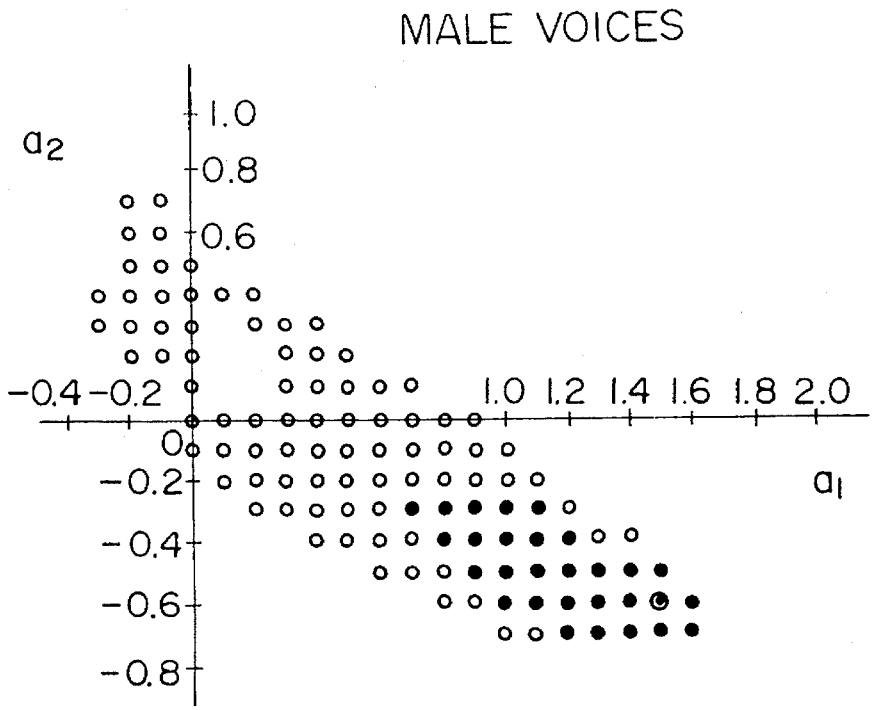
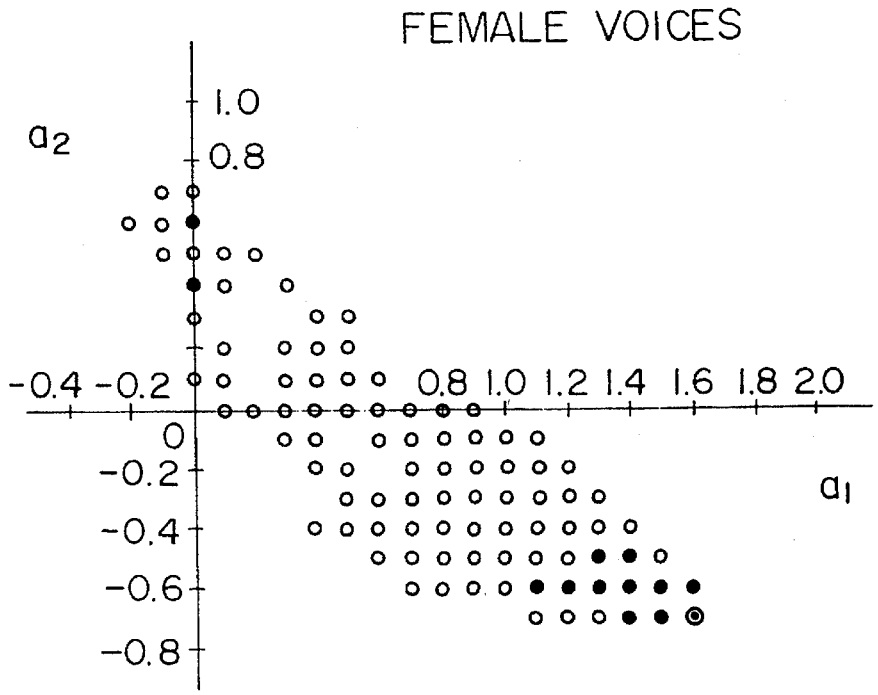
Fig. 4B

Fig. 5A
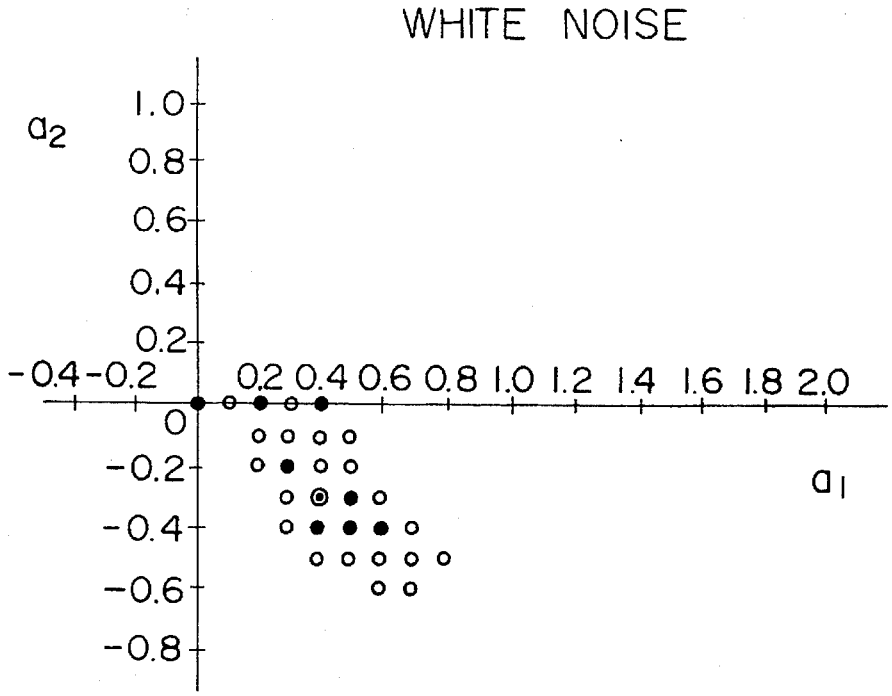
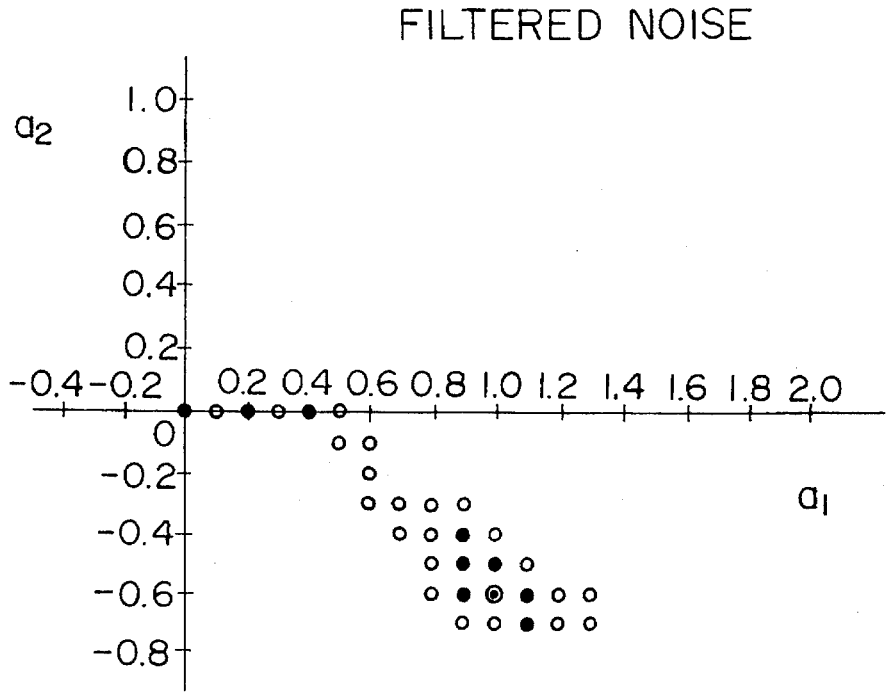
FIG. 5B

VOICE ENCODER USING A VOICE ACTIVITY DETECTOR

This is a continuation of application Ser. No. 07/907,221, filed Jul. 1,1992 now abandoned.

BACKGROUND OF THE INVENTION

The present invention relates to a voice encoder using a voice activity detector for use in a voice communication system.

Portable radio terminals, such as digital cordless telephone apparatus, employ VOX (Voice Operate Switch Exchange) control which actuates a transmitter only during voice activity and holds it out of operation during a silent duration so as to reduce power consumption during transmission, and this control reduces the mean power consumption for transmission by about 15%. To perform such a VOX function, a voice activity detector for detecting the presence or absence of a voice signal needs to be provided at a stage preceding a transmitter output circuit.

The following will be described on the assumption that such a voice activity detector is applied to VOX control of a digital cordless telephone apparatus. The digital cordless telephone utilizes a 32 kb/s adaptive differential pulse code modulation (ADPCM) system as the voice coding system (CODEC), and the processing delay time in this apparatus is required to be equal to or shorter than 7 msec.

Since the processing by a conventional voice activity detector described below is executed for each 20 msec frame, a delay time of at least 20 msec is induced, making it impossible to meet a requirement that the delay time be 7 msec or less. Moreover, the conventional voice activity detector is formed independently of the voice encoder, and hence is defective in that the amount of data to be processed is inevitably large.

SUMMARY OF THE INVENTION

It is therefore an object of the present invention to provide a voice encoder using a voice activity detector which permits the detection of voice activity or non-activity in each short period while holding the delay time to be shorter than 7 msec, through effective utilization of predictive coefficients obtainable during processing by the voice encoder having an adaptive prediction function.

In order to obtain the above object a voice encoder is provided and has two terminals for receiving, for each sample, the digital information of an input voice signal. A subtractor subtracts values to produce a difference signal, for each sample. An adaptive quantizer quantizes, for each sample, the difference signal to produce a quantized output. The quantized output for each sample is outputted through output terminals of the encoder. An inverse adaptive quantizer receptive of the quantized output, for each sample, performs an inverse-adaptive quantization thereof to produce a quantized difference signal. An adder adds the prediction signal and the quantized difference signal to obtain a reproduced signal. An adaptive predictor produces the prediction signal and two predictive coefficients from the quantized difference signal and the reproduced signal, for each sample.

A voice activity detector of the voice endoder receives the two predictive coefficients applied to respective framing circuits wherein they are framed at 5 msec intervals. The framed outputs of the framing circuits are applied to average calculator means comprising two average calculators which calculate the average values of the two predictive coefficients for each framed period of the input voice signal. Decision means are provided for holding respective ranges of predictive coefficient threshold values precalculcated from respective distributions of the two predictive coefficients and for deciding whether each framed period is a voice active period or a voice non-active period as a result of comparing the average values with the respective ranges of predictive coefficient threshold values to obtain voice active/non-active flags in correspondence to the voice active period and the voice non-active period for voice operate switch exchange of quantized output.

BRIEF DESCRIPTION OF THE DRAWINGS

The present invention will be described in detail below in comparison with prior art with reference to accompanying drawings; in which:

FIG. 4 shows the distributions of predictive coefficients $a_1$ and $a_2$;

FIG. 5 shows the distributions of the predictive coefficients $a_1$ and $a_2$;

DETAILED DESCRIPTION

To make differences between prior art and the present invention clear, an example of prior art will first be described.

Figure 6:
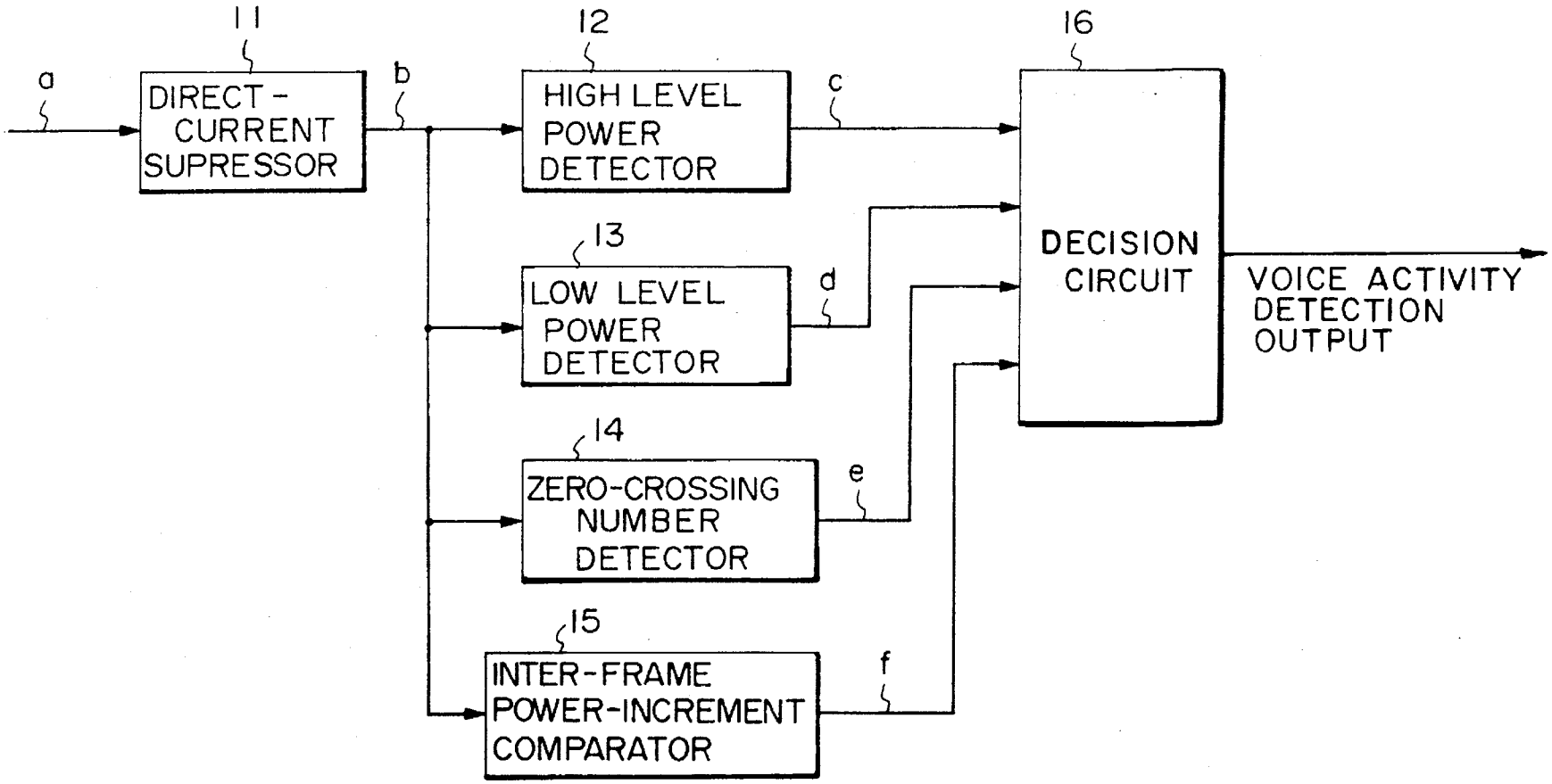
Fig. 6 PRIOR ART
FIG. 6 is a block diagram of a conventional voice activity detector.

FIG. 6 is a block diagram showing a conventional voice activity detector, which divides an input voice signal a, sampled at a sampling rate of 8 kHz and quantized by the use of 256 quantization levels, in units of 20 msec frames (each 160 samples), decides the voice activity or non-activity for each frame and outputs a voice activity/non-activity flag. The voice input signal a is applied to a direct-current suppressor 11, in which its DC component is removed by a high-pass filter and the output signal b is provided to each circuit mentioned below.

In a high level power detector 12 the 20 msec voice period is subdivided into five subframes (32 samples) of 4 msec and, for each sub-frame, a short-period power $P_{sk}$ is computed by the following Eq. (1):

$$P_{sk}=\frac{1}{32}\sum_{i=1}^{32}X_i^2 \tag{1}$$

where $X_i$ is the filter output and a notation is the subframe number.

For the power $P_{sk}$ thus computed for each subframe, the following power detection is conducted using a power threshold value Th2 (−30 dBm0).

$$\text{When } P_{sk}\geqq \mathrm{Th2},\ D_{2k}=1 \tag{2}$$

$$\text{When } P_{sk}<\mathrm{Th2},\ D_{2k}=0 \tag{3}$$

Further, a weighted sum total $D_2$ of the following Eq. (4) is obtained, which sum total is regarded as the result of detection for one frame, and a signal c is output accordingly.

$$D_2 = \sum_{k=1}^{5} k \cdot D_{2k} \tag{4}$$

In a low level power detector 13, for the short-period power calculated by Eq. (1), the following power detection is conducted using a power threshold value Th1 (50 dBm0).

$$\text{When } P_{sk} \geqq \text{Th1},\ D_{lk}=1 \tag{5}$$

$$\text{When } P_{sk} < \text{Th1},\ D_{lk}=0 \tag{6}$$

Similarly, the following weighted sum total $D_1$ is obtained, which is regarded as the result of detection for one frame, and a signal is output accordingly.

$$D_1 = \sum_{k=1}^{5} k \cdot D_{1k} \tag{7}$$

At the same time, the value of the following equation is calculated.

$$D_3 = \sum_{k=1}^{5} (6-k) \cdot D_{1k} \tag{8}$$

In a zero crossing number detector 14, $Z_{sk}$ is calculated by the following Eq. (9) for each subframe so as to count the zero crossing number of the signal (the number of different sign bits of voice signals of two successive samples).

$$Z_{sk} = \sum_{i=0}^{32} |sgn(X_{i-1} \cdot X_i)| \tag{9}$$

For each $Z_{sk}$ thus computed, the zero crossing number is detected using a zero crossing threshold value Th3 (24) as follows:

$$\text{When } Z_{sk} \geqq \text{Th3},\ DZ_{sk}=1 \tag{10}$$

$$\text{When } Z_{sk} < \text{Th3},\ DZ_{sk}=0 \tag{11}$$

Likewise, the following weighted sum total $D_z$ is calculated and a signal e is output as indicative of the result of detection for one frame.

$$D_z = \sum_{k=1}^{5} k \cdot DZ_{sk} \tag{12}$$

In an inter-frame power-increment comparator 15 the power $P_{Tn}$ of one frame is obtained by the following Eq. (13):

$$P_{Tn} = \sum_{k=1}^{5} P_{sk} \tag{13}$$

Further, the power thus obtained is compared with the inter-frame power $P_{T(n-1)}$ Of the preceding frame to detect the next power increment $D_4$, and its result is output as a signal f.

$$\text{When } P_{Tn} \geqq 4P_{T(n-1)},\ D_4=1 \tag{14}$$

$$\text{When } P_{Tn} < 4P_{T(n-1)},\ D_4=0 \tag{15}$$

Figure 7:
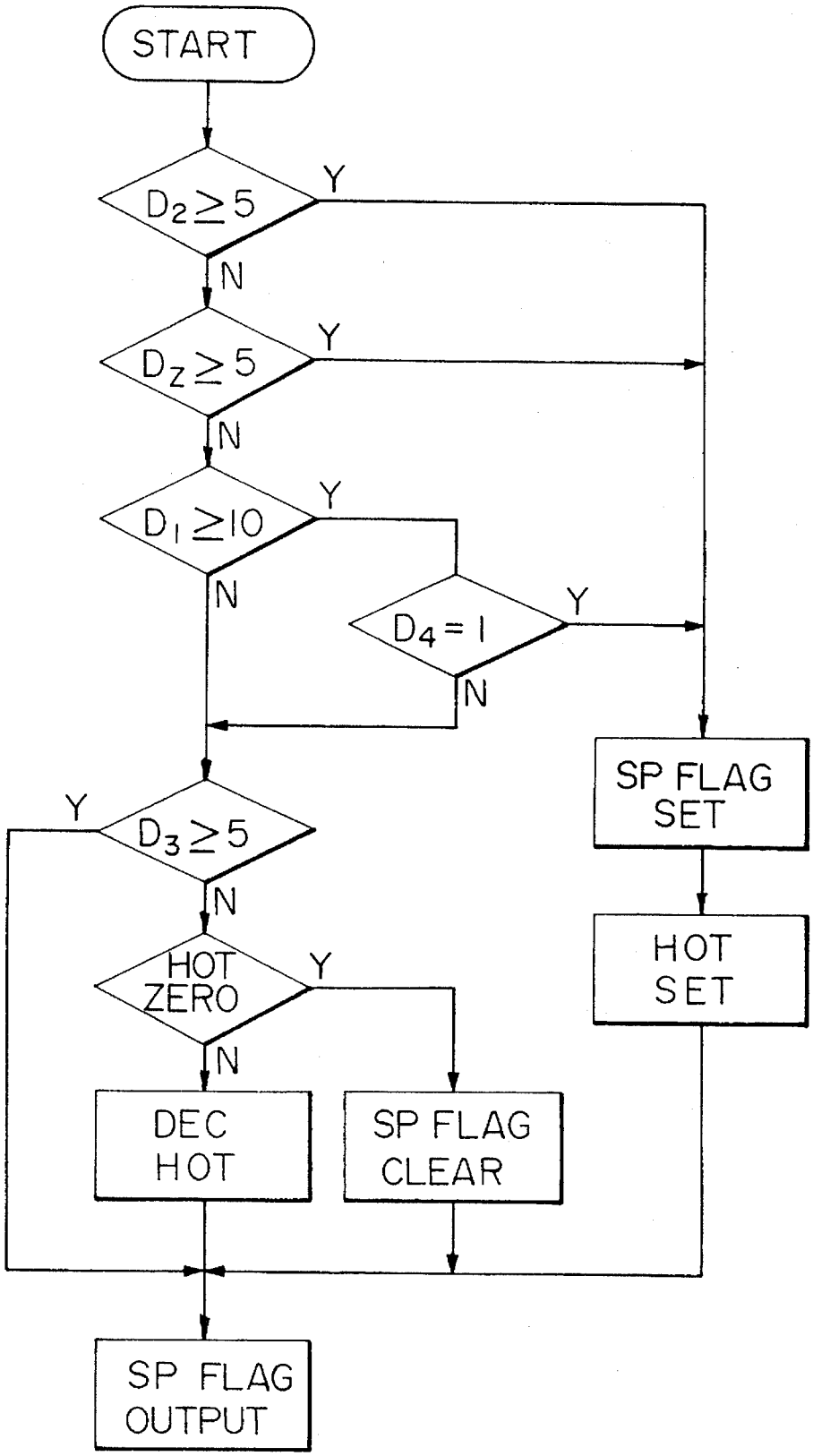
Fig. 7 PRIOR ART
FIG. 7 is a conventional decision logic flowchart.

A decision circuit 16 receives the signals c, d, e and f and outputs a voice active/non-active flag indicating the result of detection of the voice activity in accordance with a decision logic flow depicted in FIG. 7. In FIG. 7, HOT means a hang-over timer (a function by which when the decision changes from the voice activity to the voice non-activity, the subsequent several frames are set voice-active to prevent the voice activity from ending), and SP flag means a voice active/non-active flag.

[EMBODIMENT]

The present invention will hereinafter be described as being applied to a 32 kb/s (kilobit/sec) ADPCM voice encoder for the digital cordless telephone.

Figure 1:
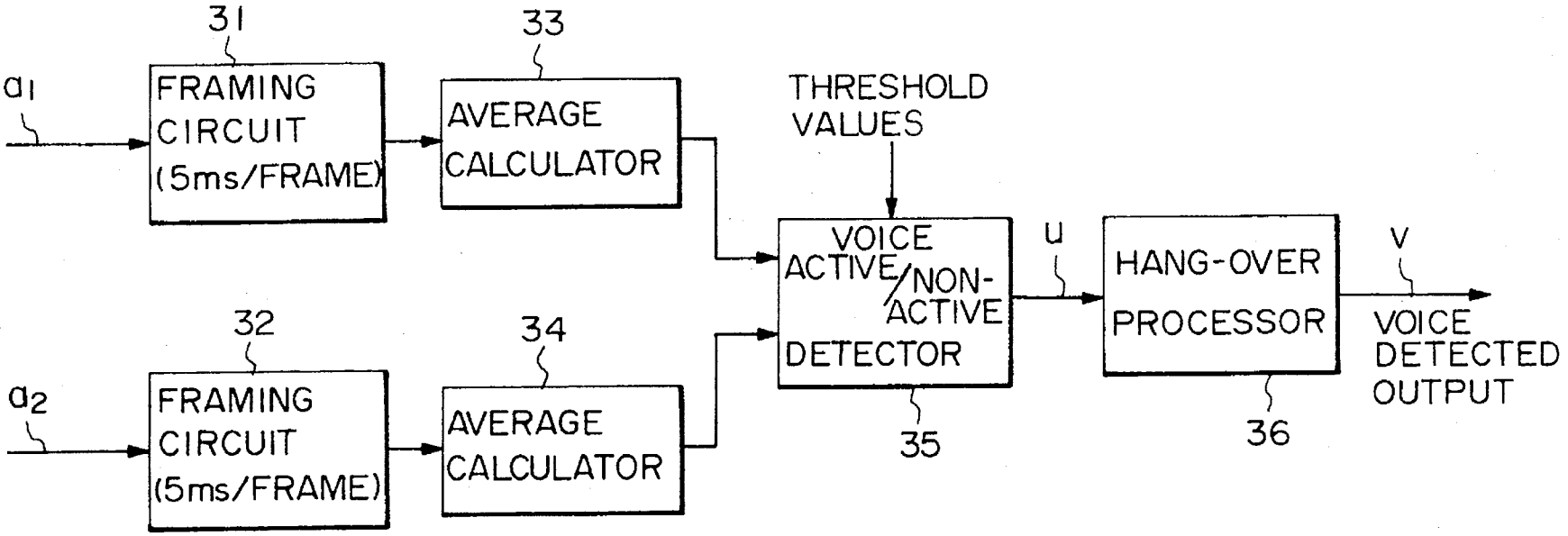
FIG. 1 is a block diagram of the voice activity detector employed in the present invention.
Figure 2A:
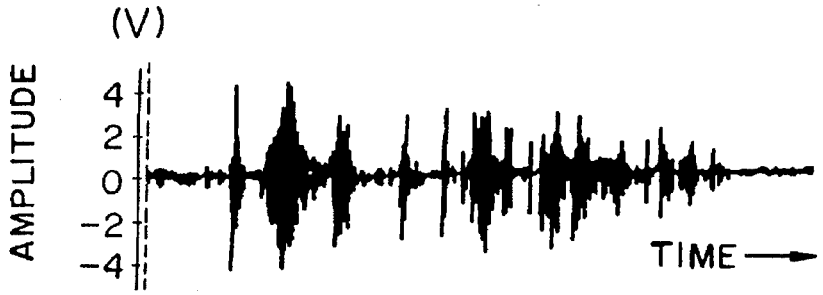
FIG. 2 illustrates timing charts explanatory of the operation of the voice activity detector employed in the present invention.
Figure 2B:
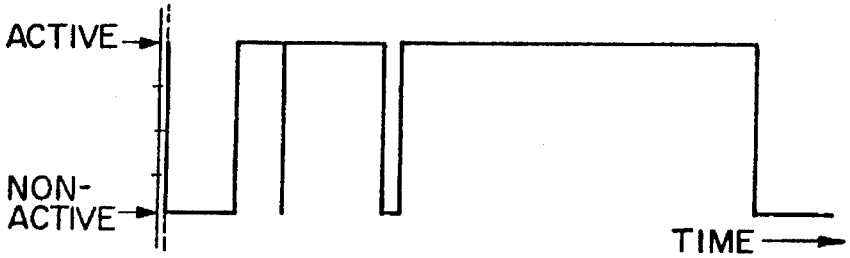
Figure 2C:
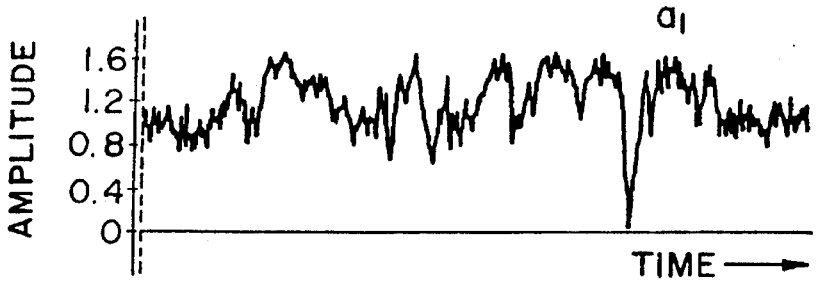
Figure 2D:
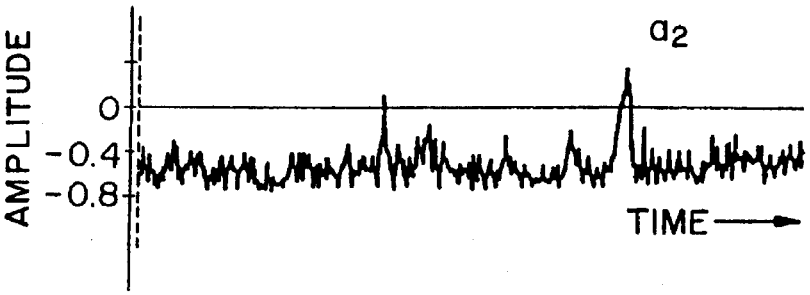
Figure 3:
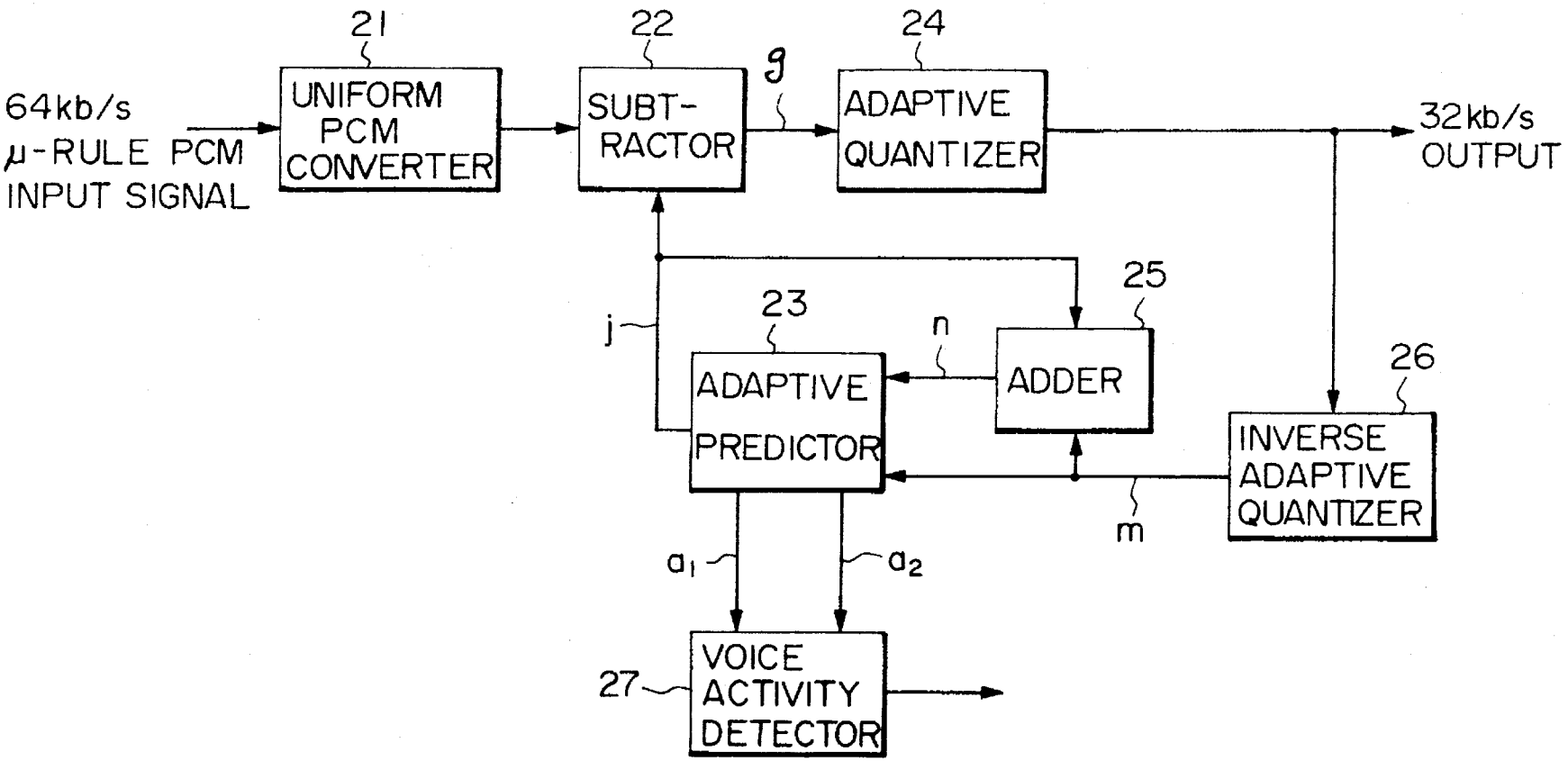
FIG. 3 is a block diagram of an ADPCM encoder using a voice activity detector of the present invention.

FIG. 3 is a block diagram of the ADPCM voice encoder using a voice activity detector according to present invention, and FIG. 1 is a block diagram illustrating an embodiment of the voice activity detector employed in the present invention.

A description will be given first of the ADPCM encoder depicted in FIG. 3. Reference numeral 21 indicates a uniform PCM converter whereby a 64 kb/s μ-rule PCM input signal is converted, for each sample, a linear 13-bit signal. Reference numeral 22 denotes a subtractor whereby a predition signal j, which is the output from an adaptive predictor 23, is subtracted from the output of the uniform PCM converter 21 to obtain a difference signal g. The difference signal g is quantized by an adaptive quantizer 24 and voice data of 32 kb/s are provided as the output of the ADPCM voice encoder on the transmission line.

On the other hand, an inverse adaptive quantizer 26 performs inverse adaptive quantization of the 32 kb/s voice data to obtain a quantized difference signal m. An adder 25 adds the quantized difference signal m and the prediction signal j to obtain a reproduced signal n.

The adaptive predictor 23 produces, for each sample, the prediction signal j by the use of predictive coefficients $a_i$ (i=1, 2) and $b_i$ (i=1, . . 6) under the principle defined by the following equations (16) and (17).

$$Se(h) = \sum_{i=1}^{2} a_i(h-l)Sr(h-i) + Se_2(h) \tag{16}$$

$$Se_2(h) = \sum_{i=1}^{6} b_i(h-l)dq(h-i) \tag{17}$$

Where

Se(h): prediction signal j

Sr(h–i): reproduced signal n $d_q$: quantized difference signal m h: instant sampling point The predictive coefficients al (i=1,2) and $b_i$ (i=1, . . . . 6 are successively renewed in the adaptive predictor 23 under a simplified process of the gradient projection method.

The predictive coefficients $a_i$ (i=1,2) and $b_i$ (i= 1, . . . . 6) have spectrum-envelope information of an input signal, and their values are differently distributed with a case of a voice signal of high auto-correlation and a case of background noise of low auto-correlation. Accordingly, an instantaneous state of an input signal can be decided for each framed period as a voice signal or background noise in accordance with the values of the predictive coefficients $a_i$ and $b_i$. In the present invention, only one kind of coefficients $a_i$ (i=1,2) except predictive coefficients $b_i$ is employed for detecting voice activity and applied to the voice detector 27.

To prove the above, examples of measured distributions of two predictive coefficients $a_1$ and $a_2$ are shown in FIGS. 4(A), 4(B) and FIGS, 5(A), (B). FIG. 4(A) shows voice signals (male voices), 4(B) voice signals (female voices), FIG. 5(A) white noise and 5(B) filtered noise (–6 dB/oct).

In FIGS. 4 and 5 the ranges of the two predictive coefficients $a_1$ and $a_2$ indicated by respective sample points, i.e. white, black and double circles, are each more than –0.05 and less than –0.05, with respect to each sample point as the origin. The sample point of the maximum frequency of generation is indicated by the double circle, and the sample point which takes a value greater than 0.1 when it is normalized by the maximum frequency of generation is indicated by the black circle.

From FIGS. 4 and 5 it is understood that the voice active period and the background noise period (i.e. the voice non-active period) can be decided using proper threshold values for the predictive coefficients $a_1$ and $a_2$. When the predictive coefficients $a_1$ and $a_2$ assume values in the ranges (1) to (5) shown below, the voice activity detector 27 decides that such periods are background noise periods, on the basis of the distribution diagrams of the predictive coefficients depicted in FIGS. 4 and 5, and when the coefficients assume other values, such periods are decided to be voice active periods. Thus the voice activity detector outputs a voice detection flag indicated by the L or H level accordingly.

(1) $(0.70 \leqq a_1 \leqq 1.00)$ and $(-0.45 < a_2 \leqq -0.35)$ (2) $(0.75 \leqq a_1 \leqq 1.10)$ and $(-0.55 < a_2 \leqq -0.45)$ (3) $(0.85 \leqq a_1 \leqq 1.20)$ and $(-0.65 < a_2 \leqq -0.55)$ (4) $(0.95 \leqq a_1 \leqq 1.20)$ and $(-0.70 < a_2 - 0.65)$ (5) $(a_1 \leqq 0.75)$ and $(a_2 \leqq 0)$ FIG. 1 is a block diagram illustrating an example of the construction of the voice activity detector employed in the present invention. The contents of processing of each block in FIG. 1 will be described. The predictive coefficients $a_1$ and $a_2$ are input into framing circuits 31 and 32, respectively, wherein they are framed at 5 msec intervals, and the framed outputs are applied to average calculators 33 and 34. The average calculators 33 and 34 each calculate the average value of the predictive coefficient for one frame and apply the calculated output to a voice active/non-active detector 35. The detector 35 sets the voice detection flag to the state of voice-non-active (L) or voice-active (H), depending on whether or not the average values of the predictive coefficients $a_1$ and $a_2$ fall inside the ranges of the threshold values (1) to (5) referred to above. The output of the detector 35 is provided to a hang-over processor 36, wherein it is subjected to hand-over processing of 100 msec to obtain an ultimate voice detected output.

FIG. 2 shows timing charts illustrating the results of confirmation of the voice activity detecting operation by computer simulation. The input signal was superimposed on filtered noise (–6 dB/oct). FIG. 2(A) shows the input signal and 2(B) the results of voice active/non-active decision after the hang-over processing. From the results shown it is seen that the system of the present invention is not likely to malfunction in response to background noise and provides good results. FIGS. 2(C) and (D) show temporal changes of the predictive coefficients $a_1$ and $a_2$, respectively. From FIGS. 2(C) and (D) it can be confirmed that the predictive coefficients $a_1$ and $a_2$ assume different values for the voice active period and the background noise period.

As described above in detail, according to the present invention, the processing time necessary for the detection of voice activity is reduced to about 5 msec and the voice activity detector employed in the present invention can be implemented with a small amount of hardware (the amount of data processing being 15% that in the ADPCM system) because of efficient utilization of coefficients obtainable in the ADPCM processing. Hence the present invention is of great utility in practical use.

What I claim is:

1. A voice encoder comprising:

input terminal means for receiving, for each sample, digital information of sampled values of an input voice signal;

a subtractor for subtracting, for each sample, a prediction signal from the digital information of the sampled values to produce a difference signal;

an adaptive quantizer for quantizing, for each sample, the difference signal to produce a quantized output;

output terminal means for outputting, for each sample, the quantized output;

an inverse adaptive quantizer for performing inverse-adaptive quantization, for each sample, of the quantized output to produce a quantized difference signal;

an adder for adding, for each sample, the prediction signal and the quantized difference signal to obtain a reproduced signal;

an adaptive predictor for producing, for each sample, the prediction signal and two predictive coefficients from the quantized difference signals and the reproduced signal;

average calculator means for producing respective average values of the two predictive coefficients produced in the adaptive predictor for each framed period of the input voice signal; and decision means for holding respective ranges of predictive coefficient threshold values precalculated from respective distributions of the two predictive coefficients and for deciding whether said each framed period is a voice active period or a voice non-active period as a result of comparing the average values provided from said average calculator means with said respective ranges of predictive coefficient threshold values to obtain voice active/non-active flags in correspondence to said voice active period and said voice non-active period for voice operate switch exchange of the quantized output.

2. A voice encoder according to claim 1, in which said respective ranges of predictive coefficient threshold values are precalculated to be greater than –0.05 and smaller than ±0.05 with respect to each sample.

* * * * *